US006679176B1

(12) United States Patent
Zavitsanos et al.

(10) Patent No.: US 6,679,176 B1
(45) Date of Patent: Jan. 20, 2004

(54) REACTIVE PROJECTILES FOR EXPLODING UNEXPLODED ORDNANCE

(76) Inventors: Peter D. Zavitsanos, P.O. Box 412, Gwynedd Valley, PA (US) 19437; Michael C. Matthews, 742 Eisenhauer Dr., Telford, PA (US) 18969; Charles W. Files, 1011 Morgan La., Perkasie, PA (US) 18944; Arno Gatti, deceased, late of Scotia, NY (US); by Madeline Gatti, administratrix, 144 Spring Rd., Scotia, NY (US) 12302; Dmitri Bohn, 5443 Hoppenville Rd., Green Lane, PA (US) 18054

( * ) Notice: Subject to any disclaimer, the term of this patent is extended or adjusted under 35 U.S.C. 154(b) by 0 days.

(21) Appl. No.: 09/586,379

(22) Filed: Jun. 2, 2000

Related U.S. Application Data

(60) Provisional application No. 60/190,829, filed on Mar. 21, 2000.

(51) Int. Cl.[7] ..... F42B 12/44

(52) U.S. Cl. ..... 102/364; 102/703; 102/517; 89/1.13

(58) Field of Search ..... 102/703, 364, 102/473, 517, 518, 519; 86/50; 89/1.13

(56) References Cited

U.S. PATENT DOCUMENTS

| | | | | | |
|---|---|---|---|---|---|
| 2,951,752 | A | * | 9/1960 | Stevenson | 149/42 |
| 3,158,991 | A | * | 12/1964 | D'Alelio | 102/291 |
| 3,257,801 | A | * | 6/1966 | Martinez et al. | 149/19.7 |
| 3,565,706 | A | * | 2/1971 | Waite | 149/19.3 |
| 3,617,405 | A | * | 11/1971 | Stevenson | 149/39 |
| 3,865,035 | A | * | 2/1975 | Munson et al. | 102/364 |
| 3,960,083 | A | * | 6/1976 | Dietzel et al. | 102/202.14 |
| 3,986,909 | A | * | 10/1976 | Macri | 149/19.9 |
| 4,402,705 | A | * | 9/1983 | Daume et al. | 102/364 |
| 4,419,936 | A | * | 12/1983 | Coates et al. | 102/364 |
| 4,432,818 | A | * | 2/1984 | Givens | 149/22 |
| 4,922,826 | A | * | 5/1990 | Busch et al. | 102/489 |
| 5,529,649 | A | * | 6/1996 | Lund et al. | 149/105 |
| 5,859,383 | A | * | 1/1999 | Davison et al. | 102/307 |
| 5,929,370 | A | * | 7/1999 | Brown et al. | 102/398 |
| 5,988,038 | A | * | 11/1999 | Feintuch | 89/1.13 |
| 6,354,222 | B1 | * | 3/2002 | Becker et al. | 102/513 |

OTHER PUBLICATIONS

"Jane's Mines and Mine Clearance", Editor: Colin King, Fourth Ed. 1999–2000.

* cited by examiner

*Primary Examiner*—Michael J. Carone
*Assistant Examiner*—Gabriel S Sukman
(74) *Attorney, Agent, or Firm*—RatnerPrestia

(57) ABSTRACT

A projectile for the destruction of unexploded ordnance comprising a dart shell having a core region which contains a reactive composition comprised of a reactive metal and an oxidizer. The reactive metal is selected from the group consisting of titanium, aluminum, magnesium, lithium, beryllium, zirconium, thorium, uranium, hafnium, alloys thereof, hydrides thereof, and combinations thereof. The oxidizer is selected from the group consisting of lithium perchlorate, magnesium perchlorate, ammonium perchlorate, potassium perchlorate, chlorates, peroxides, and combinations thereof. In an alternative embodiment, the reactive composition is located on the outside of a center penetrating rod. Also included is a disposable apparatus for delivering a projectile to destroy unexploded ordnance. The apparatus is comprised of a block having a top and a bottom, the block comprised of a material selected from the group consisting of wood and polymeric resin. Within the block is a barrel disposed on the bottom of the block, the barrel comprised of a material selected from the group consisting of fiberglass and polymeric resin.

8 Claims, 4 Drawing Sheets

REACTIVE PROJECTILES FOR EXPLODING UNEXPLODED ORDNANCE

This application claims the benefit of earlier-filed U.S. Provisional Application Ser. No. 60/190,829 filed on Mar. 21, 2000, the content of which is incorporated by reference herein.

The U.S. Government has a paid-up license in this invention and the right in limited circumstances to require the patent owner to license others on reasonable terms as provided for by the terms of Contract No. N00024-99-C-4009 awarded by the United States Navy.

FIELD OF INVENTION

This invention relates generally to the destruction of unexploded ordnance, and more specifically, to the destruction of land and sea mines.

BACKGROUND OF THE INVENTION

The elimination of unexploded ordnance (e.g. mines) from land, beaches, or sea water presents a serious problem for both military personnel and civilians. Serious humanitarian overtones exist and many methods and techniques have been devised to deal with this problem.

Detection is the first step, which is typically handled by a variety of sophisticated techniques. Once the mines are located, however, the demining activity begins and presents serious dangers. Several methods are used to actually demine an area, including: (1) using rakes, plows, or rollers to actually detonate the mines; (2) detonating explosives on top of the mine (either on the dirt above the mine or on the exposed mine itself) to cause the detonation of the mine (usually the explosives are placed on top of the mine by a boom operated remotely or by a robot); or (3) exposing the mine (i.e. by removing dirt, in the case of a land mine) and placing a flare device on top of the mine. In the case of using the flare device, the flare device causes heating from outside of the mine which eventually causes the mine's destruction through detonation or burning.

Demining in the above-described conventional ways involves open detonation of explosives (in addition to the mine itself) which introduces hazards to people, personal property, and land. These collateral risks are undesirable for obvious reasons, including the destruction of land which the military may wish to use for transport. This is especially true when the military is demining a road as it travels toward on objective. An additional problem seen with conventional mine destruction techniques, particularly on land, involves the introduction of additional metallic debris from the mine and/or the detonation device which subsequently interferes with additional mine detection, creating false positive readings of additional mines when metal detectors sweep an area.

Several, more recent, attempts have been made which utilize the use of an inert high velocity projectile which impacts the mine causing its detonation. These efforts have generally failed because of the very high velocities necessary to cause initiation of the mine. This is especially true when the mine is comprised of trinitrotoluene (TNT), which typically requires impact velocities above 3,500 feet/second. It is especially difficult to achieve these high velocities when the projectile must travel through water or dirt in order to reach the mine.

Other, related, technologies have included an attempt at introducing reactive materials or oxidizers to the TNT charge in an effort to cause its explosion. Typically, however, without enough oxygen (in the case of the delivery of reactive materials) or without a source of ignition (in the case of delivery of an oxidizer), the TNT was not effectively or regularly destroyed.

Thus, it is an object of the present invention to provide an effective mine-destroying projectile that fully neutralizes a mine without introducing additional metal debris into the mined area. Another object of the present invention is to provide a projectile which is capable of penetrating water or dirt with enough residual velocity to still penetrate the mine shell or skin and cause its neutralization through fast deflagration. Yet another object of the present invention is to provide a delivery system for the projectile that does not introduce metal debris into the mined area.

SUMMARY OF THE INVENTION

The present invention is a projectile for the destruction of unexploded ordnance comprising a dart containing a reactive composition. The reactive composition comprises a reactive element or metal selected from titanium, aluminum, magnesium, lithium, boron, beryllium, zirconium, thorium, uranium, hafnium, alloys thereof, hydrides thereof, and combinations thereof, and an oxidizer selected from lithium perchlorate, lithium chlorate, magnesium perchlorate, magnesium chlorate, ammonium perchlorate, ammonium chlorate, potassium perchlorate, potassium chlorate, and combinations thereof wherein the oxidizer is always present in a stoichiometric excess with respect to the reactive element or metal. Optionally included in the reactive composition is a binder. The most preferred metal is titanium and the most preferred oxidizer is potassium perchlorate ($KClO_4$).

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing may not be drawn to scale. Included in the drawing are the following figures.

DETAILED DESCRIPTION OF THE INVENTION

Figure 1:
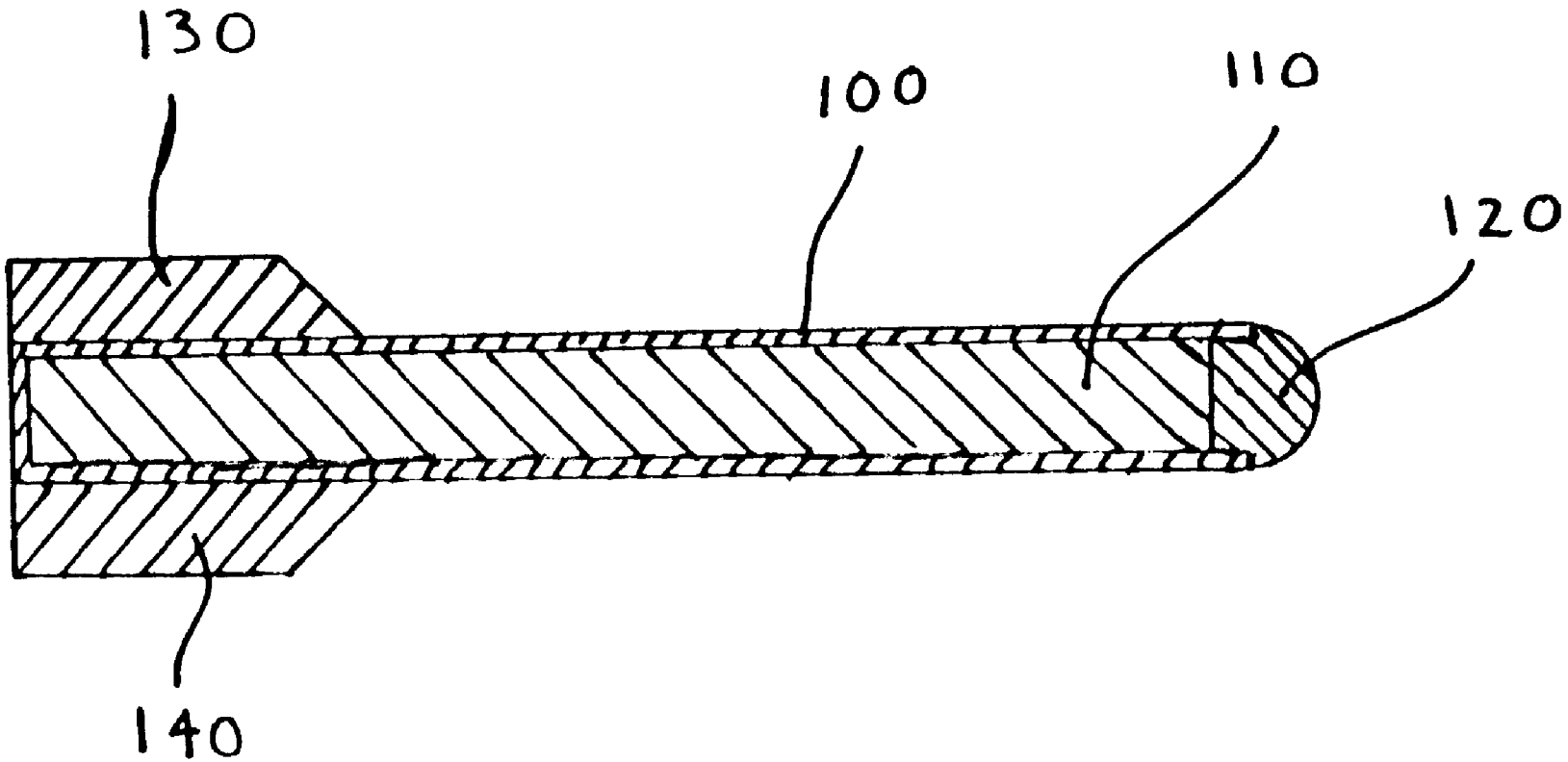
FIG. 1 is a cross sectional view of one embodiment of the projectile according to the present invention.

The invention provides a projectile for the destruction of unexploded ordnance comprising a dart filled with a reactive composition. The reactive composition is comprised of a metal selected from the group consisting of: titanium, aluminum, magnesium, lithium, boron, beryllium, zirconium, thorium, uranium, hafnium, alloys thereof, hydrides thereof, and combinations thereof. The oxidizer is selected from the group consisting of: lithium perchlorate, lithium chlorate, magnesium perchlorate, magnesium chlorate, ammonium perchlorate, ammonium chlorate, potassium perchlorate, potassium chlorate, and combinations thereof. The reactive composition also includes a binder, typically a polymer, and preferably a fluorinated polymer. If a fluorinated polymer is present as a binder, it is preferred that it be present up to 10% by weight (inclusive).

The invention has several embodiments. One is a dart that carries the reactive composition. A second embodiment is a dart comprised of the actual reactive composition. Modifications of these two embodiments include various nose configurations and flexible constructions capable of penetrating several media (sand, soil, or water) to the required target depths with sufficient residual velocity to penetrate the mine. For all embodiments, however, the reactive composition is carried by the delivery dart to the mine and is then initiated. The initiation occurs upon impact with the mine either without a separate initiator or by separate initiator such as a pressure sensitive fuse.

In the case where no separate initiator is used, the mechanical impact and subsequent deformation is relied upon to deliver sufficient energy to cause the initiation of the dart's reactive materials. Alternatively, a separate initiator, such as a plunger or primer, can be placed in the nose of the dart to initiate the reaction upon impact with the target. The former embodiment (no separate initiator) is generally preferred because of the increased risk of premature ignition where a separate initiator is used, particularly where the dart must penetrate a large amount of overburden.

The reactive composition itself is comprised of a metal and an oxidizer. A preferred composition is a mixture of potassium perchlorate ($KClO_4$) and titanium. A fluorinated polymer can be added as a binder. Although this is a preferred composition, many other exothermic mixtures consisting of a powered mixture of metal and oxidizer would also provide a reaction scheme capable of initiating self-destructive reactions within the mine's explosive material. A stoichiometric excess of oxidizer is preferred for the full benefit of the invention to be realized, an aspect of the present invention which will be described more fully below. A preferred amount of reactive metal is 5-80 wt. %, and a preferred amount of oxidizer is 5-95 wt. %. A most preferred composition has titanium present at 28.5 wt. % and potassium perchlorate present at 66.5 wt. %.

Additional (but optional) components of the system would include compounds that react with the metal prior to oxidation. In such a case, the reactants of the first reaction are subsequently oxidized. These reactive materials would include elements such as Ti (titanium), B (boron), Zr (zirconium), Al (aluminum), Hf (hafnium), C (carbon), or combinations thereof. Boron and carbon are the preferred elements used to react with the metal(s) to exothermically form the resultant intermetallic compounds. Moreover, by modifying the reactive projectiles by adding elements which exothermically form intermetallic reactants prior to oxidation, one can further increase target defeat through utilization of both primary (formation of intermetallic compound) and secondary (oxidation) reactions. As an example, where titanium, boron, and potassium perchlorate are present in the dart as the reactive components, one sees:

$$Ti+2B \rightarrow TiB_2$$

which generates up to 1.2 kcal/gm and maximum temperatures of 3,500 K. These hot $TiB_2$ particles can then further react with the oxidizer:

$$TiB_2+(\text{excess})KClO_4 \rightarrow TiO_2+B_2O_3+KCl+(\text{remainder})KClO_4$$

The remainder $KClO_4$ ultimately decomposes to KCl and $2O_2$. This secondary reaction—the oxidation step—generates an additional 3–4 kcal/g which enhances and extends the exothermic effect useful in many military and civilian applications. Typically, the front section (or nose) of the dart would contain the reactive intermetallic compound, thereby causing the initiation of the reaction to begin at the front of the dart and progress toward the rear as the dart moves through the mine during the destruction event. As stated above, the remainder potassium perchlorate not used in the oxidation of $TiB_2$ is subsequently thermally decomposed to KCl and $2O_2$ which is then available for the oxidation of the reactive material contained in the mine during self destruction (where mine destruction is the desired intent). This phenomenon is only seen where a stoichiometric excess of oxidizer is provided in the dart.

In addition to using the projectiles of the present invention for mine destruction, the projectiles have other uses. For example, the projectiles can be used for missile defense and other target destruction. Ballistic missiles, cruise missiles, aircraft, and land targets (such as armored personnel carriers, trucks, tanks, and buildings) can all be more easily destroyed through the use of the reactive material of the present invention. Another use includes breaching, or breaking into geologic stratas for military applications such as bunker defeat or commercial applications such as oil exploration. In such cases, the projectiles are used to remove debris from the target hole, a process typically referred to as "mucking".

FIG. 1 shows a cross sectional view of a projectile in accordance with one embodiment of the present invention. Dart shell 100 carries reactive material 110 within its core region. Nose 120 is either solid metal or comprised of a reactive intermetallic composite. If solid metal, nose 120 is chrome steel, steel, tungsten, or combinations thereof. The main criteria for selection of material of construction for the nose 120 is that it be hard and of a high density. If nose 120 is comprised of a reactive material to form an intermetallic composite with the metal present in the core region, a possibility discussed above, it can be comprised of any appropriate composition or composites of metals which react exothermically with the metal present in the core region.

Typically, the projectiles range in size from 3 inches in length to 7 or 8 inches in length, but other sizes would work. For land mine destruction, the projectile is usually between 3 and 6 inches in length, with a preferred embodiment being about 4.5 inches in length (4.3 to 4.7 inches). Larger dart sizes up to 12 to 20 inches in length and 1 to 3 inches in diameter can be used for penetrating buildings and destroying their contents including chemical or biological agents or fuels by starting a fire in the building.

FIG. 1 also shows fins 130 and 140. Generally, three fins are used to stabilize the dart during flight. The fins are spaced 120 degrees from center if determine the proper placement and number of fins for appropriate flight stabilization.

In order to launch the dart from a gun, a sabot is often employed. A sabot is a term known to those skilled in the art. Generally, a sabot is a sleeve that fits around part or all of the projectile to achieve two desirable results. One, the sabot stabilizes the dart as it travels through the gun barrel, which achieves better flight trajectory as the dart leaves the gun. Two, the sabot forms a seal between the dart and the inside of the gun barrel. This second aspect is desirable because the maximum amount of energy is applied to the dart as it travels down the barrel—energy which would otherwise be lost around the sides of the dart if not for the sabot. Once the dart leaves the end of the muzzle, the sabot falls away and the dart continues in its trajectory. Ordinary firearms such as rifles, however, can be used to deliver reactive projectiles, with or without fins.

Figure 2:
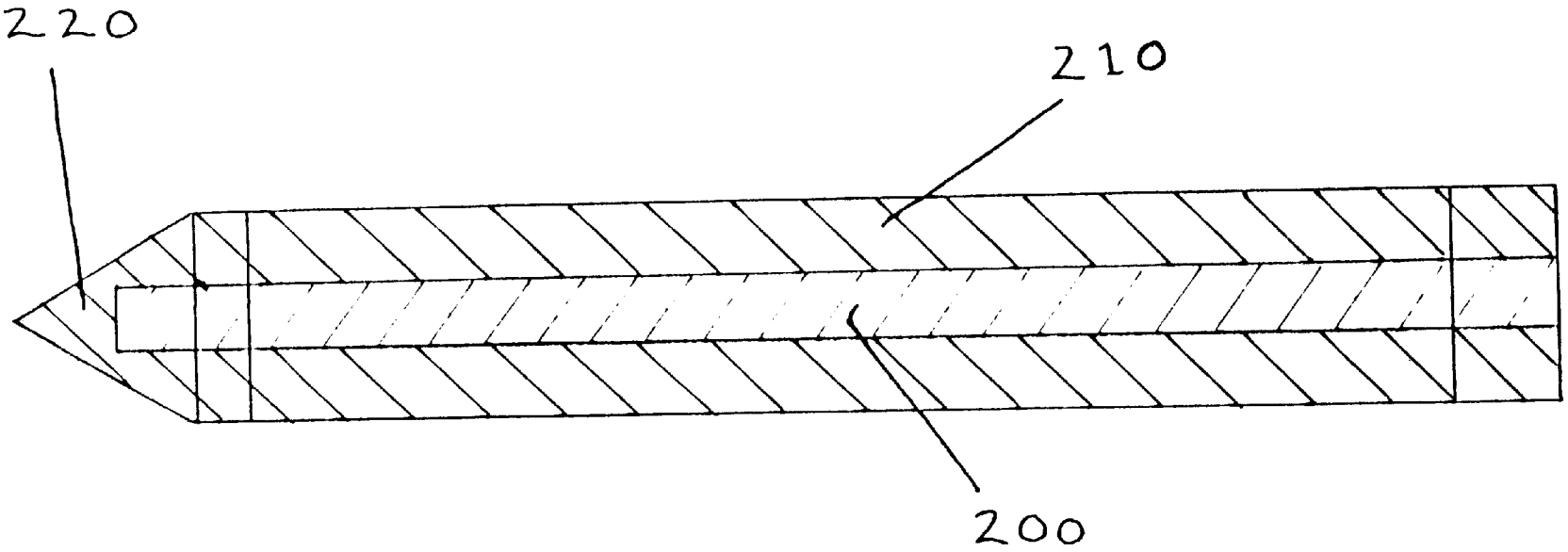
FIG. 2 is a cross sectional view of an alternative embodiment of the projectile according to the present invention.

FIG. 2 shows an alternative embodiment of the present invention where the reactive material is actually carried outside of a metal rod. This embodiment is a caseless dart where a center penetrating rod carries the reactive material as a shell. Here, center penetrating rod 200 is comprised of steel, tungsten, or combinations thereof. Reactive shell 210 is the same material as described above for reactive material 110. Nose 220 can be any shape, such as rounded (as shown for nose 120) or cone shaped, and can be comprised either of chrome steel, steel, tungsten, or combinations thereof, or of a reactive intermetallic material. Nose 220 can be comprised of the same materials as those described above for nose 120.

Figure 3:
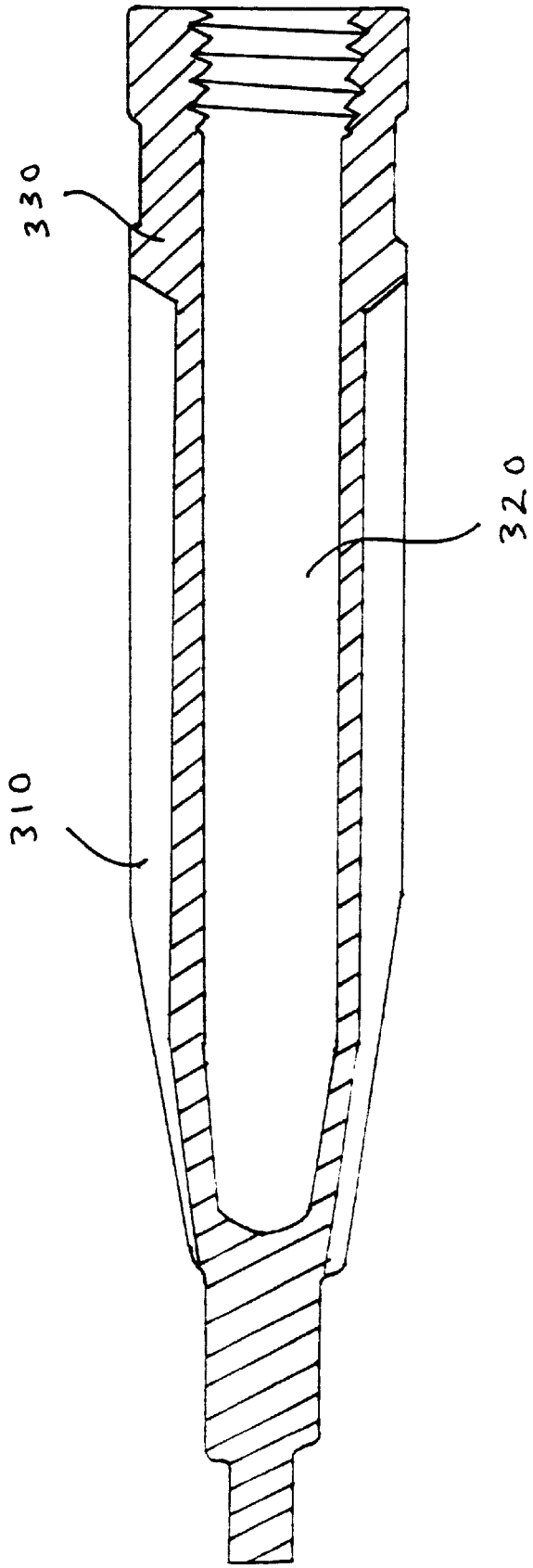
FIG. 3 is a cross sectional view of a bullet-like projectile with a cavitating nose for the defeat of sea mines.

The choice of nose shape depends upon the location of the mine for which destruction is desired. The design selected should provide superior penetration and destruction. The cone shaped nose 220 as shown in FIG. 2 is typically appropriate for penetrating sand or dirt. The rounded design, as shown in FIG. 1, is typically used where the mine for which destruction is sought is near or at the top of the ground level. A more "bullet shaped" body with a cavitating nose would be likely used where the dart is used to destroy sea mines. One example of such a shape is illustrated in FIG. 3. In FIG. 3, bevels, or groove-like cavities 310 are present along the nose to aid in penetration through water. FIG. 3 also shows an embodiment where the reactive material 320 is contained within the nose 330. Moreover, the nose design is based on the medium (or "overburden") which must be penetrated in order to reach the target. Any of the nose configurations shown can be used with any of the embodiments disclosed herein.

Land mine defeat can be accomplished by shooting the darts of the present invention at a diagonal such that the gun (and the shooter, if the gun is not automated) is a safe distance from the mine. Typically, the projectiles of the present invention are fired from a 0.50 caliber gun or smaller. Another delivery mechanism, developed specifically for the projectiles of the present invention comprises a self-destructive, portable delivery system consisting of a hard fiber tube barrel and a wooden block containing the breech. This delivery system is a single shot apparatus and is electrically initiated from a safe, remote distance.

Figure 4:
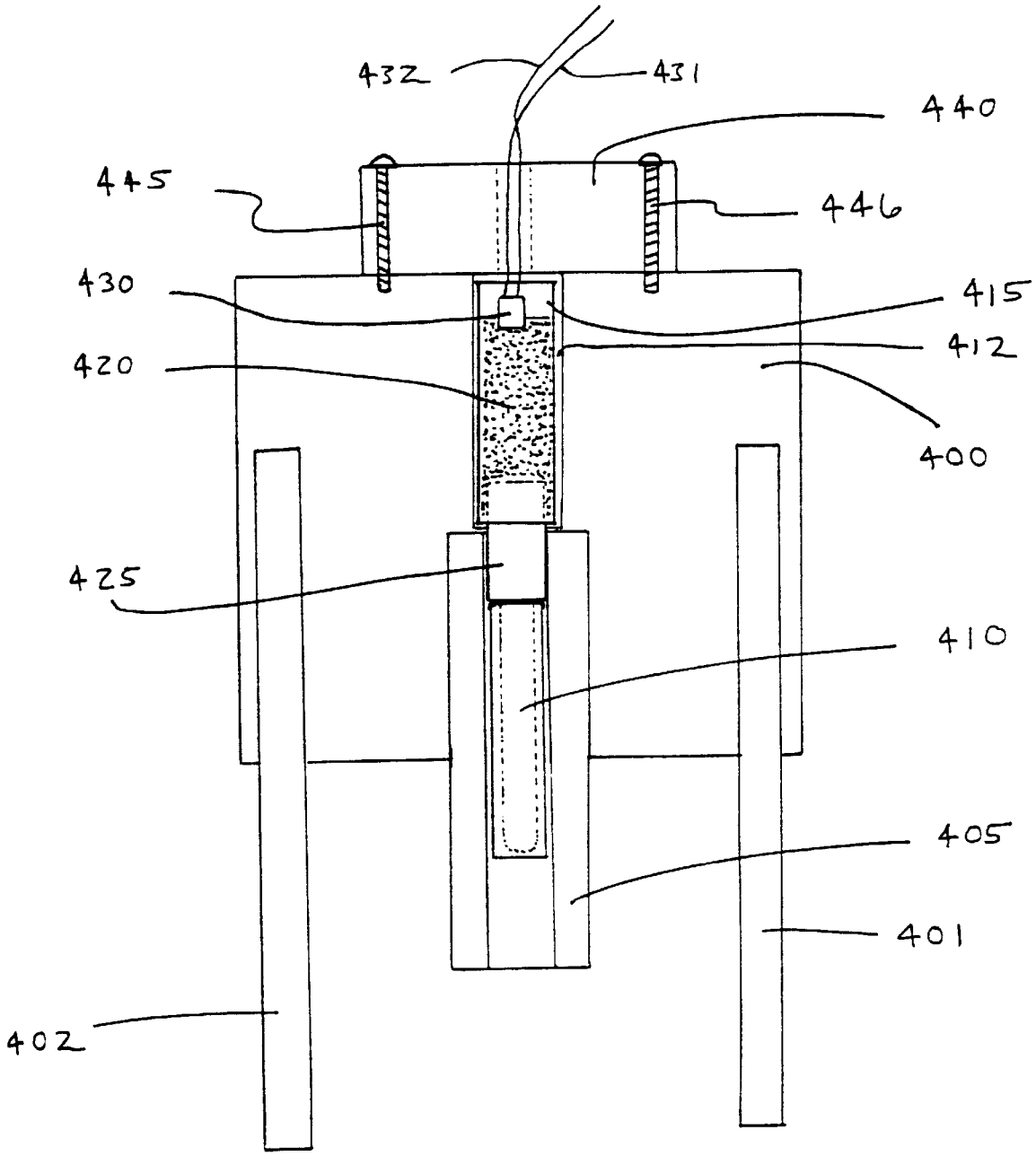
FIG. 4 is a schematic view of an apparatus used to fire the projectile of the present invention.

FIG. 4 shows such a projectile delivery system for use in conjunction with the projectile of the present invention. The key to this aspect of the present invention is that the delivery system is comprised of materials other than metal. This delivery system is a one-time, disposable apparatus. It is destroyed along with the mine over which it is placed. As discussed above, any added metal debris or fragmentation is detrimental to the later detection of additional mines in the area because false positive readings are more likely to occur.

The projectile delivery system shown in FIG. 4 is only one example of the apparatus of the invention. As shown in the embodiment of FIG. 4, a wood block 400 with wooden legs 401 and 402 (shown) (more would normally be used) houses the barrel and breech. Barrel 405 is comprised of fiberglass or galvanized cellulose, among other suitable materials. The upper bore of barrel 405 contains the saboted projectile 410 which is the projectile of the present invention. Block 400 also contains a breech 415 (a cavity) in which shell 415 is situated above barrel 405. Shell 415 contains gunpowder 420, preferably black powder. Paper wad 425 keeps the powder 420 in shell 415 even when the saboted projectile is not present, as is the case up until the apparatus is about to be used.

An electrical priming device 430, often referred to as a squib, is located in the top of shell 415. Attached to priming device 430 are wires 431 and 432. This allows remote detonation, insuring that the user will be out of harm's way. Breech block 440 is screwed, using polymeric screws 445 and 446, onto the top of wooden block 400 after shell 415 is inserted.

One aspect to the use of the apparatus according to the invention is that the non-metallic device houses only the charge, without the projectile, until the device is ready to be used to destroy a mine. This precludes the accidental discharge of the explosive projectile. In a worst-case scenario, only a wad of paper is going to be expelled from the barrel. Typically, when a mine is located and destruction is desired, the device is loaded by inserting an appropriate projectile according to the present invention into barrel 405. The device is then placed atop the mine. The wires 431 and 432 are run to a safe distance and the mine can then be destroyed.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A non-exploding projectile for the destruction of unexploded ordnance comprising:

a dart shell having a non-explosive core region; and within said core region a reactive, non-explosive composition consisting of:

a material selected from the group consisting of: titanium, aluminum, magnesium, lithium, boron, carbon, beryllium, zirconium, thorium, uranium, hafnium, alloys thereof, hydrides thereof, and combinations thereof, and an oxidizer selected from the group consisting of: lithium perchlorate, magnesium perchlorate, ammonium perchlorate, potassium perchlorate, chlorates, peroxides, and combinations thereof.

2. The projectile of claim 1 wherein said reactive metal is present at from 5–80% by weight.

3. The projectile of claim 1 wherein said oxidizer is present at from 5–95% by weight.

4. The projectile of claim 1 wherein said reactive composition further comprises a binder.

5. The projectile of claim 4 wherein said binder is a fluorinated polymer present up to 10% by weight.

6. The projectile of claim 1 wherein said metal is titanium and said oxidizer is potassium perchlorate.

7. The projectile of claim 6 wherein said titanium is present at 28.5% by weight and said potassium perchlorate is present at 66.5% by weight.

8. The projectile of claim 1 wherein said oxidizer is present in a stoichiometric excess with respect to said reactive metal.

* * * * *